United States Patent [19]

Bonac

[11] Patent Number: 4,794,961

[45] Date of Patent: Jan. 3, 1989

[54] VENEER KNIFE

[76] Inventor: Tomo Bonac, 3636 30th Avenue, Vancouver, British Columbia, Canada, V6S 1W8

[21] Appl. No.: 859,439

[22] Filed: May 2, 1986

[51] Int. Cl.[4] ..... B27L 5/00

[52] U.S. Cl. ..... 144/212; 144/241

[58] Field of Search ..... 144/209 R, 211, 212, 144/241

[56] References Cited

U.S. PATENT DOCUMENTS

| | | | |
|---|---|---|---|
| 2,652,869 | 9/1953 | Goodman et al. | 144/241 |
| 3,204,673 | 9/1965 | Nordin | 144/212 |
| 4,569,380 | 2/1986 | Arasmith | 144/241 |

FOREIGN PATENT DOCUMENTS

| | | | |
|---|---|---|---|
| 792883 | 11/1935 | France | 144/212 |
| 595160 | 2/1978 | U.S.S.R. | 144/212 |

*Primary Examiner*—W. Donald Bray

*Attorney, Agent, or Firm*—Bull, Housser & Tupper

[57] ABSTRACT

A knife, especially a veneer knife, having a wedge shaped body equipped with a leaf spring and a backing plate which retain a removable, disposable blade. The blade is inserted on the rake face of the tool under the leaf spring and wedged between the retaining plate and the rake face. Cutting forces provide main clamping of the blade.

15 Claims, 3 Drawing Sheets

FIG. 1
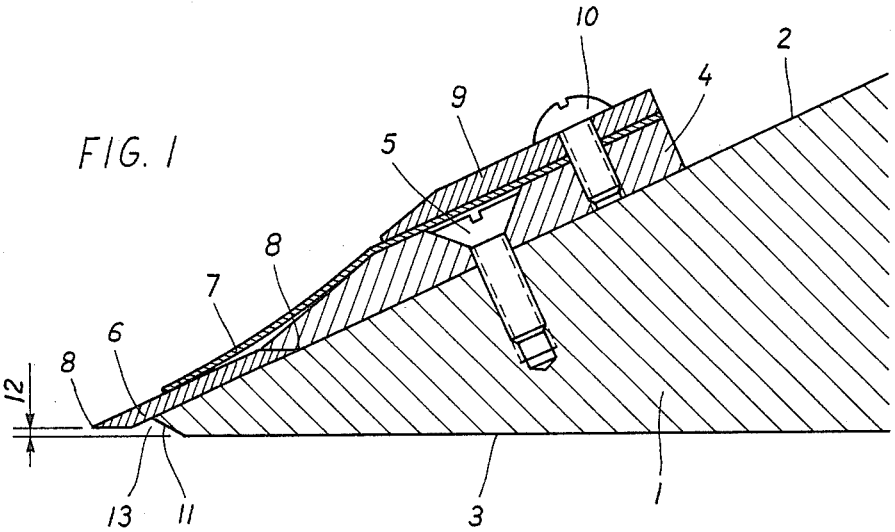
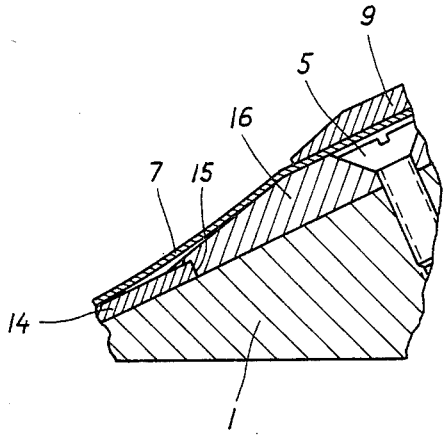
FIG. 2

VENEER KNIFE

FIELD OF THE INVENTION

The present invention relates to cutting knives in particular veneer knives or the like having a wedge-like tool body on which a cutting member is removably fixed by means of clamping and a retainer.

BACKGROUND OF THE INVENTION

The knives, which in known veneer peeling and slicing machines have stationary or move reciprocally, are relatively thick, wide, and heavy blades. Such knives are costly to maintain since a substantial amount of material has to be removed at each resharpening by expensive grinding. The setting of the knives, which is done by means of adjusting screws or babbitt casting is also time consuming. Furthermore, it is not economical to make heavy blades of better, wear resistant cutting materials, such as stainless steel 440C, and to apply advanced sharpening and coating technology to such blades.

A solution to the above problems is described in U.S. Pat. No. 3,204,673 to Nordin. The solution is based on a design of thinner blade clamped with large force between two wedge shaped holders. The disadvantage of this approach is that large clamping forces are difficult to maintain constant along the length of the knife and warpage of the assembly is a common problem. Another disadvantage is that the clamping holder, due to a large included angle, obstructs the flow of veneer and therefore cannot be located close enough to the cutting edge. Thus, the thickness of the blade cannot be substantially reduced.

SUMMARY OF THE INVENTION

The present invention overcomes the foregoing and other drawbacks by mounting thin ( typically 0.7 mm ), disposable cutting blade on the rake face ( i.e. surface in contact with veneer ) of a blade holder. The holder is a wedge-plate with the same wedge angle as the tool angle of a standard veneer knife. This arrangement allows stiff support of the blade. In the prefered embodiment, the blade is clamped against the rake face of the holder by a relatively weak leaf spring with the main purpose of keeping the blade in place between cuttings. Instead of a spring, other clamping means could be provided such as vacuum or a magnet. Vacuum would clamp the blade if applied between blade and rake face of holder. Magnetic force would clamp the blade if blade holder is made magnetic or, even easier, if the blade itself is magnetized. The advantage of all proposed clamping solutions is that they require very little space and thus do not obstruct the veneer flow. These solutions are possible because the clamping force do not need be large. Main forces holding the blade are provided by the cutting and/or pressure bar forces pressing the blade against the rake face as well as against a retainer which holds the blade non-cutting edge to the same face. The shape of the blade may be symmetrical to allow for turning to use the second cutting edge.

The advantage of the present invention is that improved cutting materials and improved sharpening technology can be applied economically to veneer knives due to small size of the cutting blade. Another advantage is the drastic reduction of the setting time since no adjustments are necessary. Worn blade is replaced simply by sliding new blade from the tool side along the edge.

The benefit of knife microbevel can be preserved in inserted knife. A microbevel applied to a standard veneer knife is known to improve the quality of veneer. If applied predominantly to the knife clearance face it also produces forces which counteract the component of cutting forces that bend the knife into the workpiece. As a result, more uniform thickness of veneer is achieved. When the microbevel is applied to the inserted knife its function is shared between the blade and the holder. On the cutting blade, a microbevel is applied to the rake face to preserve the direction of the blade clamping forces. Such microbevel improves quality of veneer. Another microbevel is applied to the clearance face of the holder to balance the cutting forces.

BRIEF DESCRIPTION OF THE DRAWINGS

The invention will now be described further, by way of example only, with reference to the accompanying drawings, in which:

FIG. 1 is a section of inserted knife according to the invention;

FIG. 2 is a modification of the embodiment shown in FIG. 1 detailing cutting blade-to-retaining plate fit;

DESCRIPTION OF THE PREFERRED EMBODIMENTS

Figure 3:
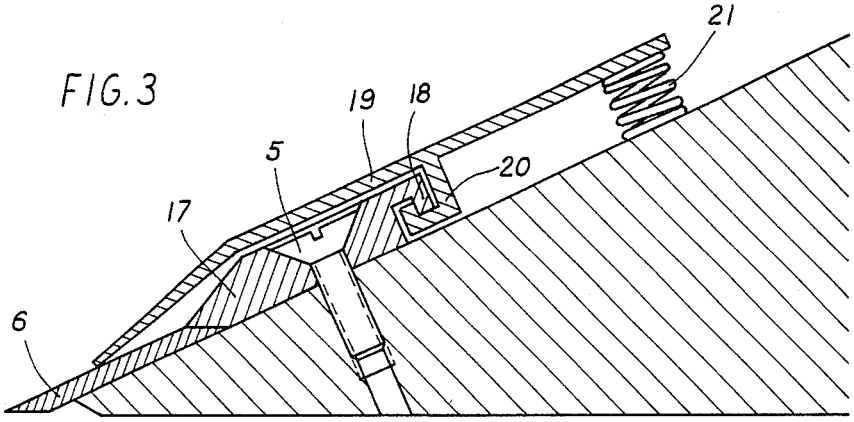
FIG. 3 is another modification of embodiment shown in FIG. 1 detailing different clamping of the cutting blade.

According to FIG. 1, a veneer knife 40 is provided with a blade holder 1 having rake face 2 and clearance face 3. Blade retaining plate 4 is secured to the rake face by means of plurality of screws 5. Cutting blade 6, which has two cutting edges 8 and 8.1 in this illustrated example, is inserted between the rake face 2 and leaf spring 7 which is secured to the retaining plate by clamp 9 and plurality of screws 10. The blade is also wedged at its edge 8.1 not oriented for cutting between the rake face 2 and the retaining plate 4. Blade holder 1 may be provided with microbevel 11 applied to the clearance face 3 to balance the cutting forces. To assure functioning of the microbevel 11 the cutting blade 6 is set at a small distance 12 from the plane touching the clearance face 3. Microbevel 11 has also an added function of preventing jamming wood fibre between blade 6 and rake face by providing opening 13 at the back of the blade.

In the modified embodiment as shown in FIG. 2 the cutting blade 14 having non-cutting edge surface 15 is used. The blade is fitted into recessed retaining plate 16.

Another modification of the embodiment, shown in FIG. 1, concerns clamping of the blade 6 and is shown in FIG. 3. A side 17.1 of the retaining plate 17 opposite blade 6 has a groove 17.2 which forms a first part 18.1 of pivot 18 on the plate. Clamp 19 carries a second part 20 on the pivot which fits to part 18. There is a compression spring 21 at end 21.1 of clamp 19 which is opposite blade 6. Spring 21 to provides clamping force acting against by means of pivot 18 the cutting blade.

Figure 4:
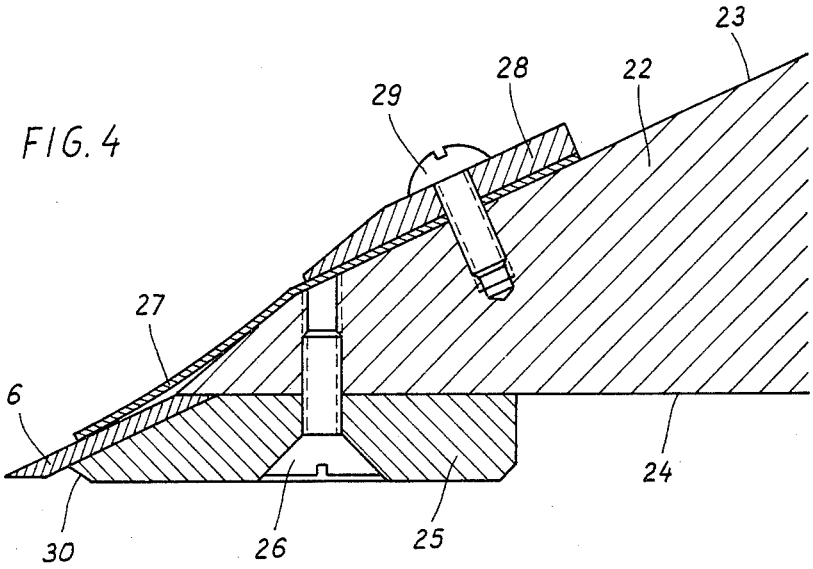
FIG. 4 is a section of second embodiment.

In the embodiment shown in FIG. 4 the veneer knife is provided with blade holder 22 having rake face 23 and clearance face 24. The principal difference, in comparison to the embodiments described previously, is that the support to the blade 6 is provided by backing plate 25 which is mounted to the clearance face 24 of the blade holder by means of plurality of screws 26. The blade is retained at its edge 30.1 not engaged in cutting by wedging between the clearance face 24 of the blade holder and the backing plate 25. Cutting blade 6 is clamped against the backing plate 25 by leaf spring 27 mounted on the rake face of the blade holder by clamp 28 and plurality of screws 29. One economical advantage of this arrangement is that backing plate 25 can be made from more wear resistant material than blade holder 22. The backing plate 25 may be provided with microbevel 30 to perform the same function as microbevel 11 in the embodiments shown in FIG. 1.

Figure 5:
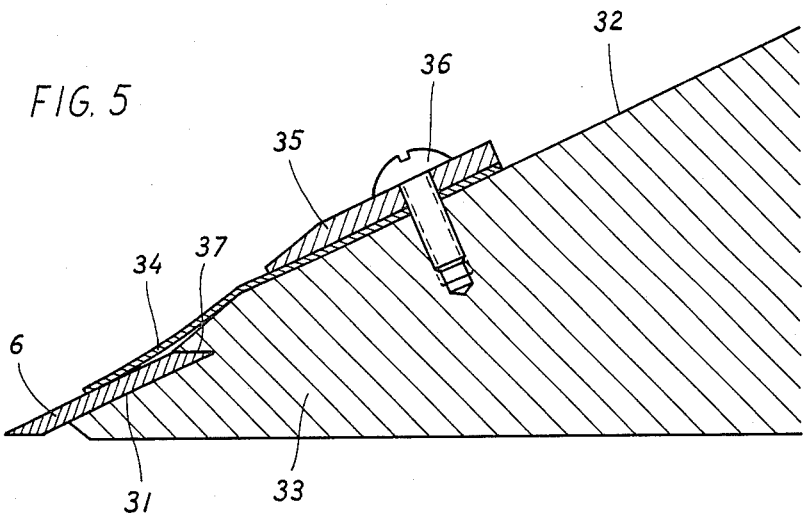
FIG. 5 is a section of another embodiment.

In the embodiment shown in FIG. 5 cutting blade 6 is inserted in recess 31 on rake face 32 of the blade holder 33. Blade 6 is clamped in recess 31 by leaf spring 34, secured by clamp 35 and plurality of screws 36, and fitted into undercut 37. This arrangement has the advantage of smaller number of parts.

Figure 6:
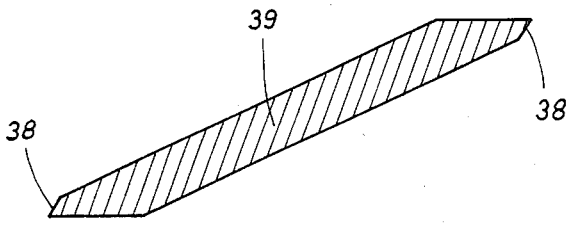
FIG. 6 is a section of microbevelled blade.

The cutting blade may be provided with microbevel 38 as shown in FIG. 6 to improve the quality of veneer. Such microbevelled blade 39 can replace blade 6 in the embodiments shown in FIGS. 1, 3, 4 or 5.

I claim:

1. A veneer knife assembly which tapers towards one end thereof and comprising:

a blade holder;

a blade having opposite first and second flat sides, a first edge at the one end of the assembly and being sharp for cutting, and a second edge opposite the first edge;

first means connected to the blade holder for contacting and supporting the first side of the blade;

second means connected to the blade holder and engaging the blade adjacent the second edge for inhibiting movement of said second edge away from the first means and away from said one end of the assembly; and third means for resiliently biasing the blade towards the first means, the blade being slidably received between said third means and said first means.

2. A veneer knife assembly as claimed in claim 1, wherein the second means includes a recess having a shape complementary to the shape of the second edge of the blade.

3. A veneer knife assembly as claimed in claim 1, wherein the third means includes a spring.

4. A veneer knife assembly as claimed in claim 1, wherein the third means includes a leaf spring having first and second ends, fourth means for connecting the leaf spring to the blade holder near the first end of the leaf spring, the second end of the spring contacting the second side of the blade and being biased towards said second side of the blade.

5. A veneer knife assembly as claimed in claim 4, wherein the second end of the leaf spring contacts the second side of the blade generally midway between the edges of the blade.

6. A veneer knife assembly as claimed in claim 5, wherein the second means includes a rigid retainer and means for connecting the retainer to the blade holder, the recess being between the blade holder and the retainer.

7. A veneer knife assembly as claimed in claim 6, wherein the first means includes a first flat surface of the blade holder.

8. A veneer knife assembly as claimed in claim 7, wherein both said edges of the blade are sharp for cutting, the recess being formed by a surface of the retainer angled with respect to the flat surface of the blade holder.

9. A veneer knife assembly as claimed in claim 7, wherein the second edge of the blade is blunt, the recess being formed by a notch in the retainer having two perpendicular faces.

10. A veneer knife assembly as claimed in claim 8, wherein the fourth means includes a rigid clamp member, the first end of the spring being clamped between the clamp member and the retainer.

11. A veneer knife assembly as claimed in claim 10, wherein the retainer is integral with the blade holder.

12. A veneer knife assembly as claimed in claim 7, having a second flat surface extending towards the one end and angled acutely with respect to the first flat surface.

13. A veneer knife assembly as claimed in claim 12, further including a beveled surface extending from the second flat surface to the first flat surface at the one end of the assembly, the beveled surface being angled less acutely than the second surface with respect to the first surface.

14. A veneer knife assembly as claimed in claim 13, wherein said surfaces are on the blade holder.

15. A veneer knife assembly as claimed in claim 3, wherein the third means includes a relatively rigid clamp having a first end and second end, the first end contacting the second side of the blade generally midway between the edges of the blade, a compression spring between the blade holder and the clamp near the second end of the clamp, and a pivotal connection between the blade holder and the clamp generally midway between the ends of the clamp.

* * * * *